US008655737B1

(12) United States Patent
Tromble

(10) Patent No.: US 8,655,737 B1
(45) Date of Patent: Feb. 18, 2014

(54) BRAND NAME SYNONYMY

(75) Inventor: Roy Tromble, Pittsburgh, PA (US)

(73) Assignee: Google Inc., Mountain View, CA (US)

( * ) Notice: Subject to any disclaimer, the term of this patent is extended or adjusted under 35 U.S.C. 154(b) by 231 days.

(21) Appl. No.: 13/018,127

(22) Filed: Jan. 31, 2011

(51) Int. Cl.
*G06Q 30/00* (2012.01)

(52) U.S. Cl.
USPC ..... 705/26.1; 705/1.1; 705/26.4; 705/26.63; 705/14.68; 705/27.1; 705/26.62; 705/26.81; 705/7.31; 705/300; 707/E17.116; 707/E17.014; 707/999.05; 707/736; 707/749; 707/750; 707/769

(58) Field of Classification Search
USPC ..... 705/26.4, 26.62, 26.8, 26.81, 27.1, 705/14.68, 7.31, 1.1, 300, 26.63; 707/E17.116, E17.014, 999.005, 736, 707/748, 749, 750, 769
See application file for complete search history.

(56) References Cited

U.S. PATENT DOCUMENTS

| | | | | |
|---|---|---|---|---|
| 2005/0261983 | A1* | 11/2005 | Etten et al. | 705/26 |
| 2008/0027830 | A1* | 1/2008 | Johnson et al. | 705/27 |
| 2008/0313165 | A1* | 12/2008 | Wu et al. | 707/5 |
| 2009/0281884 | A1* | 11/2009 | Selinger et al. | 705/14.4 |
| 2012/0303412 | A1* | 11/2012 | Etzioni et al. | 705/7.31 |

* cited by examiner

*Primary Examiner* — Yogesh C Garg
(74) *Attorney, Agent, or Firm* — King & Spalding LLP

(57) ABSTRACT

A product catalog includes information regarding products for sale online by various merchants. An analysis software module can identify brand names in the product catalog that relate to the same brand. The analysis module can compute parameters of pairs of product offers having matching product identifiers. The analysis module can group the product offer pairs into brand pair groups based on the brand names for the products subject to the product offers. The analysis module can compute parameters of each brand pair group based on product offer pairs in the brand pair group and attributes of product offers in the product catalog. The analysis module can use the computed parameters to determine whether the brand names of each brand pair are related. The analysis module can use the identified related brand names and additional attributes of product offers to identify product offers related to the same product.

29 Claims, 5 Drawing Sheets

BRAND NAME SYNONYMY

TECHNICAL FIELD

The present disclosure relates generally to electronic product catalogs, more specifically, to identifying related brand names and using the identified related brand names and additional attributes of product offers to identify product offers related to the same product.

BACKGROUND

Computer networks, such as the Internet, enable transmission and reception of a vast array of information. In recent years, for example, some commercial retail stores have attempted to make product information available to customers over the Internet. It is becoming increasingly popular for information providers to provide mechanisms by which consumers can compare such product information across multiple manufacturers and retailers. For simplicity, manufacturers, retailers, and others that sell products to customers are interchangeably referred to herein as "merchants." For example, Internet search/shopping sites allow customers to compare pricing information for products across multiple merchants.

Typically, such comparisons are based on information provided in data feeds from the merchants to the information providers. This data should be of good quality to be useful. However, merchants are not uniform in their description of brands. In addition to simple variations such as "LEXAR" versus "LEXAR MEDIA" and "PILOT" versus "PILOT PEN of AMERICA," there are much more difficult variations such as "BAND-AID" versus JOHNSON & JOHNSON" for which brand name string similarity is not useful. In addition, merchants are not uniform in their use of product identifiers. The product identifiers can include global trade item numbers ("GTINs"), such as international standard book numbers ("ISBNs") universal product codes ("UPCs"), and European article numbers ("EANs"), brand name and model number combinations, and other standard identifiers. Therefore, it is desirable to provide a mechanism for determining whether two product offers relate to the same product, which does not rely solely on matching brand names or matching product identifiers.

SUMMARY

In certain exemplary embodiments, related brand names are identified using information regarding a plurality of product offers. Each product offer can include a brand name identifying a brand for a product subject to the product offer and a product identifier identifying the product. Each of the product offers can be associated with at least one other product offer to create product offer pairs. Each product offer pair can include an association between a first product offer and a second product offer. Each first product offer can include a first brand name. Each second product offer can include a second brand name. Each first product offer and each second product offer can include similar product identifiers. Each product offer pair can include a brand name pair formed from the first brand name and the second brand name. A computer can identify at least one group of product offer pairs that have the same brand name pair. For each product offer pair, at least one product parameter can be computed based on at least one first attribute of the first product offer and at least one second attribute of the second product offer in the product offer pair. For each group of product offer pairs that has the same brand name pair, at least one brand parameter can be computed based on the product offer pairs associated with the brand pair group. The computer can determine, for each group of product offer pairs that has the same brand name pair, whether the first brand name is related to the second brand name based at least on the at least one product parameter of each product offer pair of the group of product offer pairs that has the same brand name pair and the at least one brand pair parameter of the group of product offer pairs that has the same brand name pair.

In certain exemplary embodiments, a computer-implemented method for generating an electronic product catalog, includes a computer receiving information regarding a plurality of product offers from a plurality of information sources. The computer can perform a statistical analysis on the received information to identify product offers related to the same product. The computer also can generate the electronic product catalog including the identified product offers organized into groups based on the product that the identified products are related to.

These and other aspects, objects, features, and advantages of the exemplary embodiments will become apparent to those having ordinary skill in the art upon consideration of the following detailed description of illustrated exemplary embodiments, which include the best mode of carrying out the invention as presently perceived.

DETAILED DESCRIPTION OF EXEMPLARY EMBODIMENTS

Overview

Figure 1:
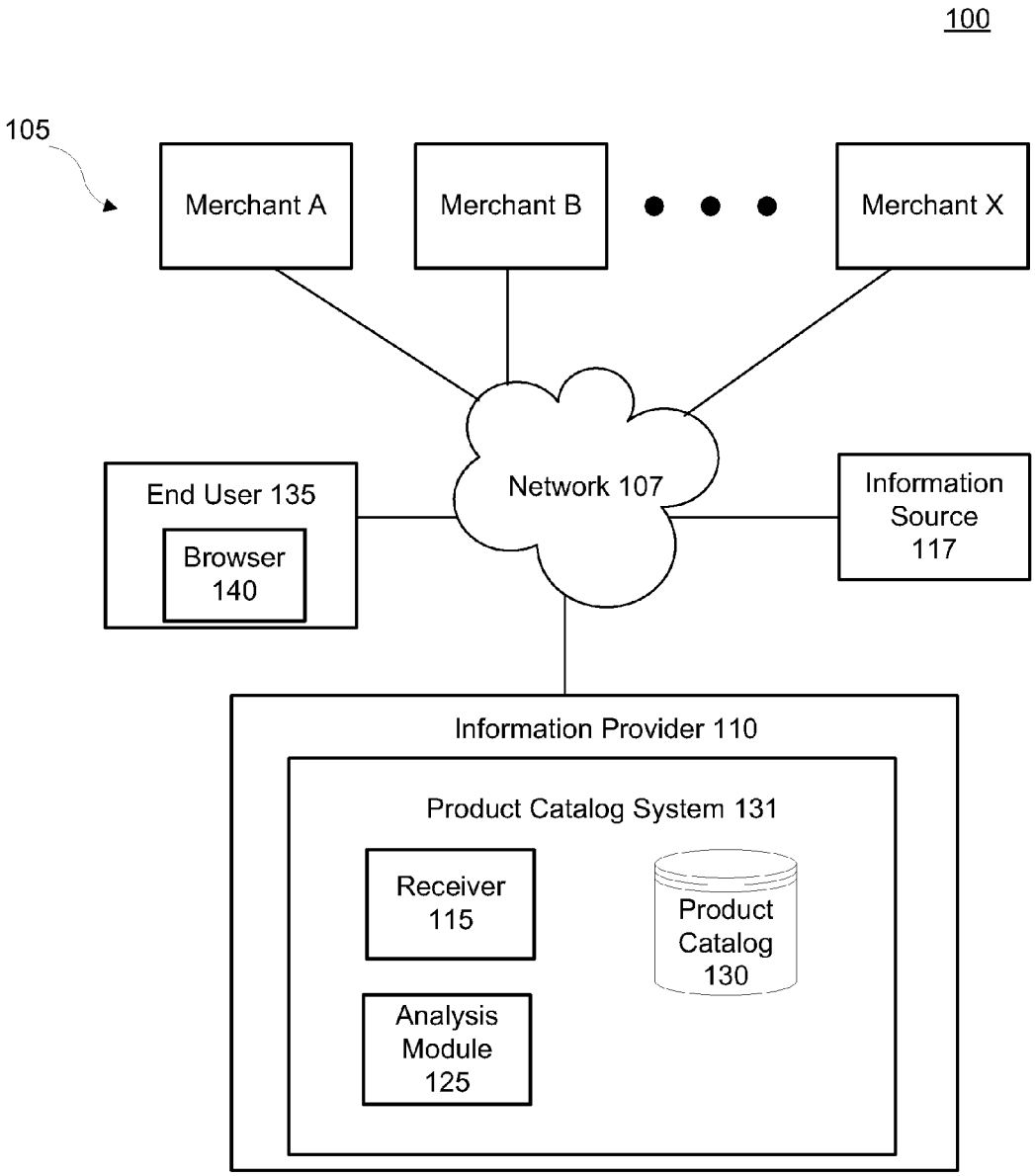
FIG. 1 depicts a system for identifying related brand names and product offers that relate to the same product, in accordance with certain exemplary embodiments.

The method and system described herein enable identification of related brand names and further enable identification of related product offers using the brand name relation and additional attributes of the product offers. As used throughout this specification, the term "products" should be interpreted to include tangible and intangible products, as well as services. The system includes a product catalog system, which is implemented in hardware and/or software. The product catalog system receives information regarding product offers from multiple merchants. Generally, this information includes, for each product offer, a brand name or manufacturer name and a product identifier for a product subject to the product offer. For example, the product identifier can include a global trade item number ("GTIN"), universal product code ("UPC"), international standard book number ("ISBN"), European article number ("EAN"), manufacturer's part number ("MPN"), brand name and model number combination, and/or other standardized identifiers. The product identifiers also can include merchant provided numbers, such as stock keeping units ("SKUs") or a random number in place of correct UPCs or EANs. The information also can include, for each product offer, a product title and an offer price for the subject product or any other information associated with the product offer.

An analysis module of the product catalog system can identify related brand names and product offers that relate to the same product using the received information. The analysis module can rely on several product offer similarity measures and aggregate statistics for product offers from one or more merchants or other data providers and product offers with the same or similar brand/manufacturer name. The analysis module can apply logistic regression or another machine learning method to these features to learn a model for classifying pairs of brand names ("brand pairs"). The analysis module can use a confidence threshold to divide those classifications into acceptable and unacceptable (or related and unrelated) brand pairs. The analysis module can use the classification of brand pairs for each pair of product offers along with product identifiers or other attributes of the pair of product offers to determine whether the product offers relate to the same product. The analysis module can generate a product catalog that includes the products and the product offers that relate to the products.

One or more aspects of the exemplary embodiments may include a computer program that embodies the functions described and illustrated herein, wherein the computer program is implemented in a computer system that comprises instructions stored in a machine-readable medium and a processor that executes the instructions. However, it should be apparent that there could be many different ways of implementing the exemplary embodiments in computer programming, and the exemplary embodiments should not be construed as limited to any one set of computer program instructions. Further, a skilled programmer would be able to write such a computer program to implement an embodiment based on the appended flow charts and associated description in the application text. Therefore, disclosure of a particular set of program code instructions is not considered necessary for an adequate understanding of how to make and use the exemplary embodiments. The functionality of the exemplary embodiments will be explained in more detail in the following description, read in conjunction with the figures illustrating the program flow.

Turning now to the drawings, in which like numerals indicate like (but not necessarily identical) elements throughout the figures, exemplary embodiments are described in detail.

System Architecture

FIG. 1 depicts a system 100 for identifying related brand names and product offers that relate to the same product, in accordance with certain exemplary embodiments. As depicted in FIG. 1, the system 100 includes network devices 105, 110, 117, and 135 that are configured to communicate with one another via one or more networks 107. Each network 107 includes a wired or wireless telecommunication means by which network devices (including devices 105, 110, 117, and 135) can exchange data. For example, each network 107 can include a local area network ("LAN"), a wide area network ("WAN"), an intranet, an Internet, or any combination thereof. Throughout the discussion of exemplary embodiments, it should be understood that the terms "data" and "information" are used interchangeably herein to refer to text, images, audio, video, or any other form of information that can exist in a computer-based environment.

Each network device 105, 110, 117, 135 includes a device capable of transmitting and receiving data over the network 107. For example, each network device 105, 110, 117, 135 can include a server, desktop computer, laptop computer, smartphone, handheld computer, personal digital assistant ("PDA"), or any other wired or wireless, processor-driven device. In the exemplary embodiment depicted in FIG. 1, the network devices 105, 110, 117, 135 are operated by merchants, an information provider, an information source, and end user customers, respectively.

The end user network devices 135 each include a browser application module 140, such as Microsoft Internet Explorer, Firefox, Netscape, Google Chrome, or another suitable application for interacting with web page files maintained by the information provider network device 110 and/or other network devices. The web page files can include text, graphic, images, sound, video, and other multimedia or data files that can be transmitted via the network 107. For example, the web page files 107 can include one or more files in the HyperText Markup Language ("HTML"). The browser application module 140 can receive web page files from the information provider network device 110 and can display the web pages to an end user operating the end user network device 135. In certain exemplary embodiments, the web pages include information from a product catalog 130 of a product catalog system 131, which is maintained by the information provider network device 110. The product catalog system 131 is described in more detail hereinafter with reference to the method illustrated in FIG. 2.

System Process

Figure 2:
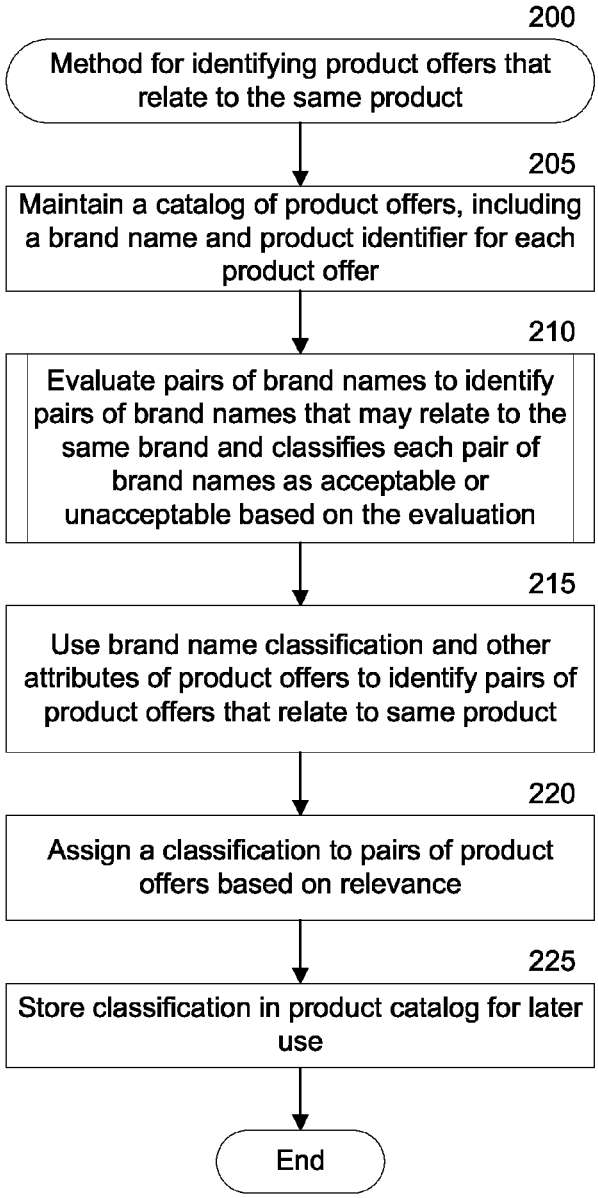
FIG. 2 is a block flow diagram depicting a method for identifying product offers that relate to the same product, in accordance with certain exemplary embodiments.

FIG. 2 is a block flow diagram depicting a method 200 for identifying product offers that relate to the same product, in accordance with certain exemplary embodiments. The method 200 is described with reference to the components illustrated in FIG. 1.

In block 205, the product catalog system 131 maintains the product catalog 130. The product catalog 130 includes a data structure, such as one or more databases and/or electronic records, that includes information regarding product offers from at least one merchant 105. For each product offer, the information in the catalog 130 includes a brand name and/or manufacturer name for the product that is the subject of the product offer. The information also includes at least one identifier for the product, such as a GTIN, MPN, ISBN, UPC, EAN, SKU, brand name and model number combination, and/or another standardized or non-standardized identifier. The information also can include a title and an offer or sale price for the product or any other information associated with the product or product offer.

In certain exemplary embodiments, a receiver module 115 of the product catalog system 131 receives information that is included in the product catalog 130 in electronic data feeds and/or hard copy provided by one or more merchants 105 and/or another information source 117, such as a specialized information aggregator. For example, each merchant 105 and/or information source 117 may periodically provide batched or unbatched product offer data in an electronic feed to the receiver module 115. The receiver module 115 also may receive product offer data from scanned product documentation and/or catalogs. In certain exemplary embodiments, the receiver module 115 also may receive the product offer data from a screen scraping mechanism, which is included in or associated with the product catalog system 131. For example, the screen scraping mechanism may capture product information from merchant and/or information provider websites. In certain exemplary embodiments, end users may view information from the product catalog 130 via browsers 140 on their respective end user network devices 135.

In block 210, an analysis module 125 of the product catalog system 131 evaluates pairs of brand names ("brand pairs") for product offers in the product catalog 130 to identify pairs of brand names that may relate to the same brand. The analysis module 125 classifies the brand pairs as acceptable or unacceptable (or related or unrelated) based on the evaluation. In one example, the analysis module 125 determines that the brand names "LEXAR" and "LEXAR MEDIA" relate to the same brand and classifies the brand pair of "LEXAR" and "LEXAR MEDIA" as acceptable. Block 210 is described in more detail hereinafter, with reference to FIG. 3.

In block 215, the analysis module 125 uses the brand pair classification of two brand names and other attributes of product offers to identify product offers that relate to the same product. In certain exemplary embodiments, the analysis module 125 evaluates each pair of product offers in the product catalog 130 to determine whether the pair of product offers relate to the same product. If the analysis module 125 has classified the brand name for a first product offer as acceptable with respect to the brand name of a second product offer and the two product offers have other similar or matching information, the analysis module 125 may determine that the first and second product offers relate to the same product. For example, the analysis module 125 may determine that the brand pair of "LEXAR" and "LEXAR MEDIA" are acceptable, and thus relate to the same brand in block 210. For each pair of product offers that include an acceptable brand pair, the analysis module 125 evaluates other attributes of the pair of product offers to determine whether the pair of product offers relate to the same product. For example, the analysis module 125 may evaluate titles for the products of the two product offers, model numbers and other product identifiers, product description, price, and/or any other information associated with the two product offers.

In block 220, the analysis module 220 assigns a classification to each pair of product offers ("product pair classification") based on the evaluation in block 215. In certain exemplary embodiments, the analysis module 125 assigns a product pair classification of "unrelated" to pairs of product offers that do not include an acceptable brand pair. If a pair of product offers includes an acceptable brand pair, the analysis module 125 assigns a product pair classification of related or unrelated based on the evaluation of the other attributes. If the analysis module 125 determines that the product offers are sufficiently similar, the analysis module 125 assigns a classification of "related" to the pair of product offers. Otherwise, if the analysis module 125 determines that the product offers are not sufficiently similar, then the analysis module 125 assigns a product pair classification of "unrelated" to the pair of product offers.

In block 225, the analysis module 125 stores the product classification for each pair of product offers in the product catalog 130 or another storage location. The product pair classification can be used for displaying product information or product offers to the end user operating the end user network device 135. For example, the end user may query the product catalog 130 or information provider 110 for information regarding a particular product. In response, the information provider 110 may return information associated with product offers that relate to that product. The information provider 131 can use the product pair classification to determine which of the product offers to provide to the end user network device 135 for display to the end user.

Figure 3:
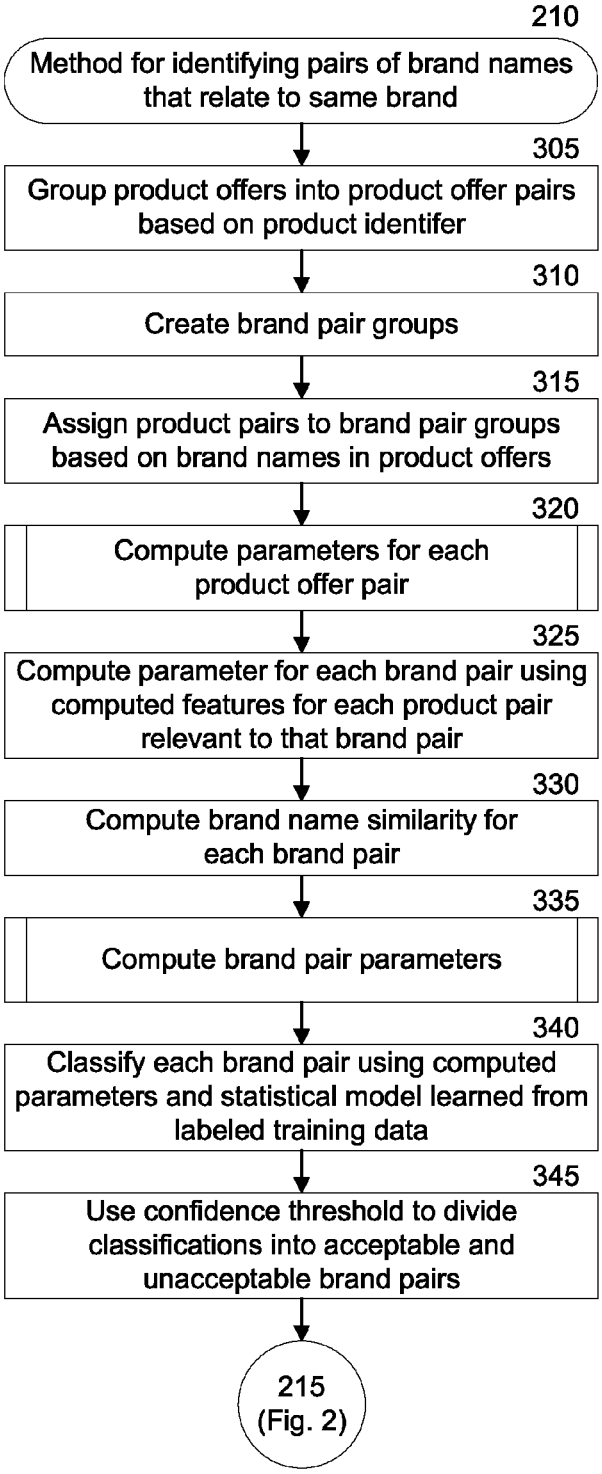
FIG. 3 is a block flow diagram depicting a method for determining whether pairs of brand names refer to same brand, in accordance with certain exemplary embodiments.

FIG. 3 is a block flow diagram depicting a method 210 for identifying pairs of brand names that relate to same brand, in accordance with certain exemplary embodiments, as referenced in block 210 of the method 200 of FIG. 2. In block 305, the analysis module 125 groups the product offers into product offer pairs each having two product offers with a matching or sufficiently similar product identifier. In certain exemplary embodiments, the analysis module 125 groups the product offers into product offer pairs using a matching GTIN, MPN, ISBN, UPC, EAN, SKU, or other product identifier. For simplicity, the method 210 is described in terms of grouping product offers into product offer pairs having a matching MPN. However, any other product identifier could be substituted for the MPN in certain alternative exemplary embodiments.

A product offer may be associated with more than one product offer pair. For example, there may be several product offers having the same MPN. Each of these product offers would be included in a product offer pair with each other product offer having the same MPN. For example, if the product catalog 130 includes three product offers having an MPN of 123, the first product offer would be included in a first product offer pair with the second product offer and in a second product offer pair with the third product offer. In addition, a third product offer pair would include the second product offer and the third product offer. A product offer may not be associated with any product offer pairs. For example, a product offer may have a product identifier that does not match a product identifier of any other product offer in the product catalog 130.

In block 310, the analysis module 125 creates a brand pair group for each brand pair. In certain exemplary embodiments, the analysis module 125 evaluates the population of product offer pairs and identifies the population of brand pairs in the product offer pairs. For example, one or more product offer pairs may include a first product offer with a brand name of "LEXAR" and a second product offer with a brand name of "LEXAR MEDIA.' The analysis module 125 would create a brand pair group for {LEXAR, LEXAR MEDIA}. Another one or more product offers may include a first product offer with a brand name of "BAND-AID" and a second product offer with a brand name of "JOHNSON & JOHNSON." The analysis module 125 would create a brand pair group for {BAND-AID, JOHNSON & JOHNSON}.

In block 315, the analysis module 125 populates the brand pair groups with the product offer pairs that include product offers with brand names matching the brand names of the brand pair group. Continuing the previous example, the analysis module 125 assigns the product offer pairs that include a first product offer with a brand name of "LEXAR" and a second product offer with a brand name of "LEXAR MEDIA" to the {LEXAR, LEXAR MEDIA} brand pair group. In addition, the analysis module 125 assigns product offer pairs that include a first product offer with a brand name of "LEXAR MEDIA" and a second product offer with a brand name of "LEXAR" to the {LEXAR, LEXAR MEDIA} brand pair group. Similarly, the analysis module 125 assigns product offer pairs that include a first product offer with a brand name of "BAND-AID" and a second product offer with a brand name of "JOHNSON & JOHNSON" to the {BAND-AID, JOHNSON & JOHNSON} brand pair group. In addition, the analysis module 125 assigns product offer pairs that include a first product offer with a brand name of "JOHNSON & JOHNSON" and a second product offer with a brand name of "BAND-AID" to the {BAND-AID, JOHNSON & JOHNSON} brand pair group.

In block 320, the analysis module 125 computes certain parameters for each product offer pair based on attributes of the product offers of the product offer pair. These computed features can include one or more of a title similarity, a GTIN (or other product identifier) similarity, a price similarity, and a MPN (or other product identifier) complexity. Block 320 is described in further detail hereinafter, with reference to FIG. 4.

In block 325, the analysis module 125 computes a single parameter for each brand pair using the computed parameters for the product offer pairs in that brand pair group. In certain exemplary embodiments, the analysis module 125 computes the arithmetic mean of the parameters for the product offer pairs in the brand pair group. In certain exemplary embodiments, the analysis module 125 computes the arithmetic mean of a portion of the parameters for the product offer pairs in the brand pair group In block 330, the analysis module 125 computes a brand name similarity for each brand pair. In certain exemplary embodiments, the analysis module 125 computes the brand name similarity as a measure of the similarity between the two brand name strings of the brand pair. For example, this brand name string similarity may be computed as one minus the edit distance between the two brand name strings, divided by the length of the longer of the two brand name strings. That is, the brand name string similarity may be one minus the number of single characters that must be changed to convert from one brand name string to the other brand name string, divided by the number of characters in the longer of the two brand names strings.

In certain exemplary embodiments, the analysis module 125 computes the brand name similarity as a measure of the similarity between brand tokens of the brand pair. For example, this brand name token similarity may be computed as the cosine similarity of the tokens in the brand name strings, after lowercasing.

In certain exemplary embodiments, the analysis module 125 computes both the brand name string similarity and the brand name token similarity for each brand pair. In certain exemplary embodiments, the analysis module 125 assigns the higher value of the brand name string similarity and the brand name token similarity as the brand name similarity.

In block 335, the analysis module 125 computes brand pair parameters based on attributes of product offers in the brand pair group and attributes of the total population (or a portion of the total population) of product offers in the product catalog 130. These computed features can include one or more of a brand overlap, a GTIN (or other product identifier) overlap, and a MPN overlap. Block 335 is described in more detail hereinafter, with reference to FIG. 5.

In block 340, the analysis module 125 classifies each brand pair as acceptable or unacceptable (or as related or unrelated) based on the parameters computed in blocks 320-335. In certain exemplary embodiments, the analysis module 125 uses a statistical model learned from labeled training data to classify each brand pair using the computed parameters for that brand pair as an input to the statistical model. The analysis module 125 can use the computed parameters for the product offer pairs in the brand pair group for the brand pair (computed in block 320), the computed features for the brand pair (computed in block 335), and the brand similarity computed in block 330 as inputs to the statistical module. In certain exemplary embodiments, the output of the statistical model includes a classification for the brand pair, for example as acceptable or unacceptable.

In certain exemplary embodiments, the statistical model provides an output value for each brand pair. For example, this output value may indicate a probability that the brand names of the brand pair are related. The analysis module 125 can compare, for each brand pair, the output value to a confidence threshold. The analysis module 125 can classify those brand pairs having an output value meeting or exceeding the confidence threshold as acceptable or related. Likewise, the analysis module 125 can classify those brand pairs having an output value that does not meet or exceed the confidence threshold as unacceptable or unrelated. In certain exemplary embodiments, the model used by the analysis module 125 is learned using logistic regression. However, many other machine learning methods are feasible, including decision trees, support vector machines ("SVMs"), perceptron, and neural networks to name a few.

Figure 4:
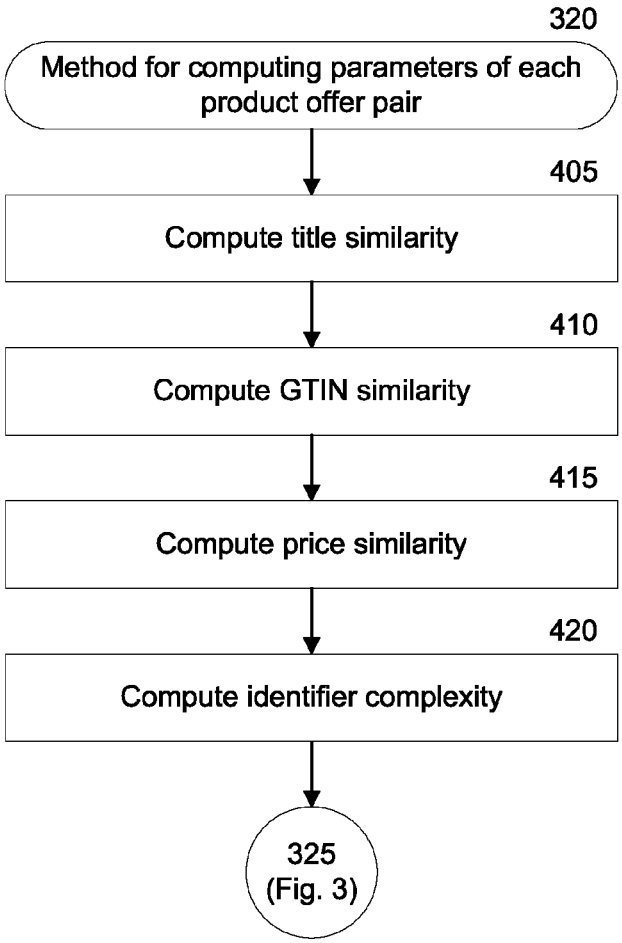
FIG. 4 is a block flow diagram depicting a method for computing parameters of product offer pairs, in accordance with certain exemplary embodiments.

FIG. 4 is a block flow diagram depicting a method 320 for computing parameters of product offer pairs, in accordance with certain exemplary embodiments, as referenced in block 320 of the method 210 of FIG. 2. In block 405, the analysis module 125 computes a title similarity for each product offer pair. The title similarity is a measure of the similarity between the product titles of the products subject to the two product offers of the product offer pair. In certain exemplary embodiments, the title similarity is computed as the cosine similarity of tokens in the product titles.

In certain exemplary embodiments, the title similarity is the cosine similarity of tokens in the product titles after lowercasing the product titles and removing any instances of matching MPNs (or other product identifier, such as GTIN) in the product titles that led to the forming of the product offer pair. For example, consider a product offer pair with a first product offer having a product with the title of "ABC123 widget—blue," a brand name of "ABC," and an MPN of "123." The product offer pair also has a second product offer having a product with the title of "ABC123 blue widget," a brand name of "ABC, Inc.," and an MPN of "123." In this example, the product offer pair was formed in response to the two product offers having a matching MPN of "123." Because the two titles include an MPN of "ABC123" rather than "123," the MPN "ABC123" would not be removed from the title before computing the cosine similarity.

In block 410, the analysis module 125 computes a GTIN similarity for each product offer pair. The GTIN similarity is a measure of the similarity between the GTINs of the products subject to the two product offers of the product offer pair. In certain exemplary embodiments, the GTIN similarity is computed as the ratio of the length of the longest shared prefix of the GTINs to the length of the longest GTIN of the product offer pair. In certain exemplary embodiments, the GTIN similarity computed as the ratio of the length of the longest shared prefix of the GTINs, ignoring any leading zeroes, to the longest GTIN, also ignoring leading zeroes.

In block 415, the analysis module 125 computes a price similarity for each product offer pair. The price similarity is a measure of the similarity between the prices of the products subject to the two product offers of the product offer pair. In certain exemplary embodiments, the price similarity is computed as the ratio of the smaller price to the larger price in the product offer pair.

In block 420, the analysis module 125 computes an identifier complexity for each product offer pair. In certain exemplary embodiments, the identifier complexity is the length in characters in which the MPNs (or other product identifier, such as GTIN, used to form the product offer pair) of the products subject to the product offers of the product offer pair matches. In certain exemplary embodiments, the identifier complexity is the length in characters in which the product identifiers used to form the product offer pair match, excepting that sequences of multiple zeroes count as a single character only. In certain exemplary embodiments, the identifier complexity is the length in characters in which the product identifiers used to form the product offer pair match, excepting that sequences of multiple matching characters count as a single character only.

Although the method 315 includes the computation of a title similarity, a GTIN similarity, a price similarity, and an identifier complexity, one or more of the computations may be excluded in certain alternative exemplary embodiments. In addition, similarity and/or complexity of other attributes of product offers in a product offer pair may also be computed in certain alternative exemplary embodiments. For example, the analysis module 125 may also compute the similarity between product descriptions, product images, product accessories, or any other attribute.

Figure 5:
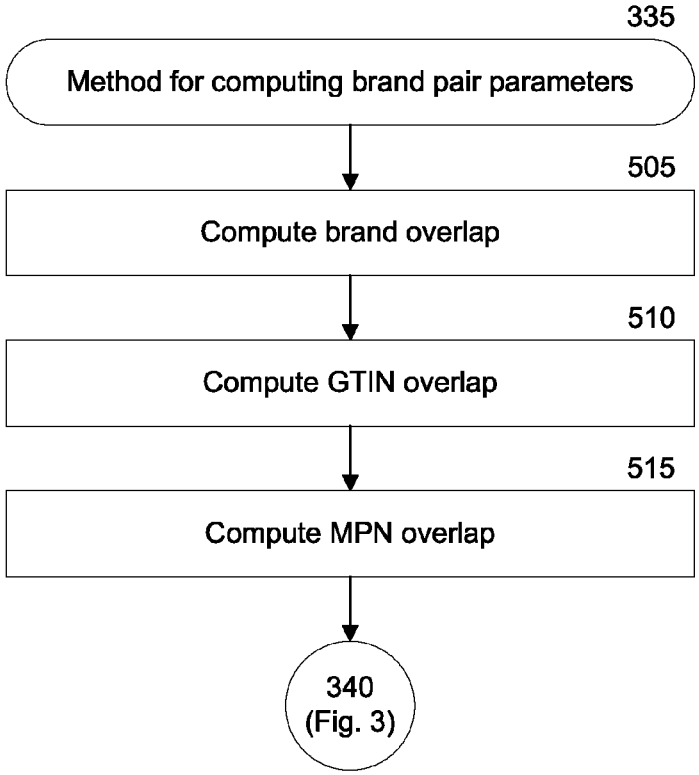
FIG. 5 is a block flow diagram depicting a method for computing parameters of brand pairs, in accordance with certain exemplary embodiments.

FIG. 5 is a block flow diagram depicting a method 335 for computing parameters of brand pairs, in accordance with certain exemplary embodiments, as referenced in block 335 of the method 210 of FIG. 3. In block 505, the analysis module 125 computes a brand overlap parameter for each brand pair. In certain exemplary embodiments, the brand overlap parameter is computed as the total number of product offer pairs assigned to the brand pair group for the brand pair, divided by the geometric mean of the total number of product offers for each brand name in the product catalog 130.

In block 510, the analysis module 125 computes a GTIN overlap parameter for each brand pair. In certain exemplary embodiments, the GTIN overlap parameter is computed as the number of distinct GTINs found in the product offer pairs in the brand pair group for the brand pair, divided by the geometric mean of the number of GTINs that occur for each brand name in the product catalog 130.

In block 515, the analysis module 125 computes an MPN overlap parameter for each brand pair. In certain exemplary embodiments, the MPN overlap parameter is computed as the number of distinct MPNs found in the product offer pairs in the brand pair group for the brand pair, divided by the number of MPNs that occur for each brand name in the product catalog 130.

General

The exemplary methods and blocks described in the embodiments presented previously are illustrative, and, in alternative embodiments, certain blocks can be performed in a different order, in parallel with one another, omitted entirely, and/or combined between different exemplary methods, and/or certain additional blocks can be performed, without departing from the scope and spirit of the invention. Accordingly, such alternative embodiments are included in the invention described herein.

The invention can be used with computer hardware and software that performs the methods and processing functions described above. As will be appreciated by those having ordinary skill in the art, the systems, methods, and procedures described herein can be embodied in a programmable computer, computer executable software, or digital circuitry. The software can be stored on computer readable media. For example, computer readable media can include a floppy disk, RAM, ROM, hard disk, removable media, flash memory, memory stick, optical media, magneto-optical media, CD-ROM, etc. Digital circuitry can include integrated circuits, gate arrays, building block logic, field programmable gate arrays (FPGA), etc.

Although specific embodiments of the invention have been described above in detail, the description is merely for purposes of illustration. Various modifications of, and equivalent blocks corresponding to, the disclosed aspects of the exemplary embodiments, in addition to those described above, can be made by those having ordinary skill in the art without departing from the spirit and scope of the invention defined in the following claims, the scope of which is to be accorded the broadest interpretation so as to encompass such modifications and equivalent structures.

What is claimed is:

1. A computer-implemented method for identifying related brand names using information regarding a plurality of product offers, each product offer comprising a brand name identifying a brand for a product subject to the product offer and a product identifier identifying the product, the method comprising:

receiving, by a computer system, the plurality of product offers;

identifying, by the computer system, two or more product offers from the received plurality of product offers that have similar product identifiers;

responsive to identifying two or more product offers with similar product identifiers, creating, by the computer system, one or more product offer pairs with the identified two or more product offers, wherein each product offer pair comprises a first product offer and a second product offer, and wherein the first product offer comprises a first brand name and the second product offer comprises a second brand name;

extracting, by the computer system, the first brand name from the first product offer and the second brand name from the second product offer of each of the one or more product offer pairs;

responsive to extracting, creating, by the computer system, based on the first brand name and the second brand name of each of the one or more product offer pairs, by the computer system, one or more brand name pairs;

responsive to creating the one or more brand name pairs, identifying, by the computer system, at least one group of product offer pairs that have the same brand name pair;

determining, by the computer system, for each product offer pair, at least one product parameter based on at least one first attribute of the first product offer and at least one second attribute of the second product offer in the product offer pair;

determining, by the computer system, for each group of product offer pairs that has the same brand name pair, at least one brand parameter based on the product offer pairs associated with the brand pair group;

applying, by the computer system, a machine learned classifier model to the at least one product parameter of each product offer pair of the group of product offer pairs that has the same brand name pair and the at least one brand pair parameter of the group of product offer pairs that has the same brand name pair; and determining, by the computer system, for each group of product offer pairs that has the same brand name pair, whether the first brand name is related to the second brand name based on an output of the machine learned classifier model.

2. The method of claim 1, wherein each product offer further comprises a title for the product subject to the product offer and wherein the at least one product parameter comprises a measure of similarity between the title for the product subject to the first product offer and the title for the product subject to the second product offer.

3. The method of claim 1, wherein each product offer further comprises a global trade item number ("GTIN") for the product subject to the product offer and wherein the at least one product parameter comprises a measure of similarity between the GTIN for the product subject to the first product offer and the GTIN for the product subject to the second product offer.

4. The method of claim 1, wherein each product offer further comprises a price for the product subject to the product offer and wherein the at least one product parameter comprises a measure of similarity between the price for the product subject to the first product offer and the price for the product subject to the second product offer.

5. The method of claim 1, wherein the at least one product parameter comprises a measure of complexity between the product identifier for the product subject to the first product offer and the product identifier for the product subject to the second product offer.

6. The method of claim 1, wherein the at least one brand parameter comprises a measure of similarity between the first brand name and the second brand name of the brand name pair.

7. The method of claim 1, wherein the at least one brand pair parameter comprises a total number of product offer pairs in the group of product offer pairs that has the same brand name pair divided by a geometric mean of a total of the number of product offers of the plurality of product offers that comprise the first brand name and product offers of the plurality of product offers that comprise the second brand name.

8. The method of claim 1, wherein each product offer further comprises a global trade item number ("GTIN") for the product subject to the product offer and wherein the at least one brand pair parameter comprises a total number of distinct GTINs in the group of product offer pairs that has the same brand name pair divided by a geometric mean of the total number of distinct GTINs in the product offers of the plurality of product offers that comprise the first brand name and the total number of distinct GTINs in the product offers of the plurality of product offers that comprise the second brand name.

9. The method of claim 1, wherein each product offer further comprises a manufacturer part number ("MPN") for the product subject to the product offer and wherein the at least one brand pair parameter comprises a total number of distinct MPNs in the group of product offer pairs that has the same brand name pair divided by a geometric mean of the total number of distinct MPNs in the product offers of the plurality of product offers that comprise the first brand name and the total number of distinct MPNs in the product offers of the plurality of product offers that comprise the second brand name.

10. The method of claim 1, wherein parameters of the machine learned classifier model are determined using logistic regression.

11. A computer program product, comprising: a computer-readable storage device having computer-readable program code embodied therein for identifying related brand names using information regarding a plurality of product offers, each product offer comprising a brand name identifying a brand for a product subject to the product offer and a product identifier identifying the product, the computer-readable program code, when executed by a processor, implements a plurality of steps comprising:

receiving the plurality of product offers;

identifying two or more product offers from the received plurality of product offers that have similar product identifiers;

creating one or more product offer pairs with the identified two or more product offers, responsive to identifying two or more product offers with similar product identifiers;

wherein each product offer pair comprises a first product offer and a second product offer, and wherein the first product offer comprises a first brand name and the second product offer comprises a second brand name;

extracting the first brand name from the first product offer and the second brand name from the second product offer of each of the one or more product offer pairs;

creating one or more brand name pairs based on the first brand name and the second brand name of each of the one or more product offer pairs, responsive to extracting the first brand name and the second brand name;

identifying at least one group of product offer pairs that have the same brand name pair, responsive to creating the one or more brand name pairs;

computing, for each product offer pair, at least one product parameter based on at least one first attribute of the first product offer and at least one second attribute of the second product offer in the product offer pair;

computing, for each group of product offer pairs that has the same brand name pair, at least one brand parameter based on the product offer pairs associated with the brand pair group;

applying a machine learned classifier model to the at least one product parameter of each product offer pair of the group of product offer pairs that has the same brand name pair and the at least one brand pair parameter of the group of product offer pairs that has the same brand name pair; and determining for each group of product offer pairs that has the same brand name pair, whether the first brand name is related to the second brand name based on an output of the machine learned classifier model.

12. The computer program product of claim 11, wherein each product offer further comprises a title for the product subject to the product offer and wherein the at least one product parameter comprises a measure of similarity between the title for the product subject to the first product offer and the title for the product subject to the second product offer.

13. The computer program product of claim 11, wherein each product offer further comprises a global trade item number ("GTIN") for the product subject to the product offer and wherein the at least one product parameter comprises a measure of similarity between the GTIN for the product subject to the first product offer and the GTIN for the product subject to the second product offer.

14. The computer program product of claim 11, wherein each product offer further comprises a price for the product subject to the product offer and wherein the at least one product parameter comprises a measure of similarity between the price for the product subject to the first product offer and the price for the product subject to the second product offer.

15. The computer program product of claim 11, wherein the at least one product parameter comprises a measure of complexity between the product identifier for the product subject to the first product offer and the product identifier for the product subject to the second product offer.

16. The computer program product of claim 11, wherein the at least one brand parameter comprises a measure of similarity between the first brand name and the second brand name of the brand name pair.

17. The computer program product of claim 11, wherein the at least one brand pair parameter comprises a total number of product offer pairs in the group of product offer pairs that has the same brand name pair divided by a geometric mean of a total of the number of product offers of the plurality of product offers that comprise the first brand name and product offers of the plurality of product offers that comprise the second brand name.

18. The computer program product of claim 11, wherein each product offer further comprises a global trade item number ("GTIN") for the product subject to the product offer and wherein the at least one brand pair parameter comprises a total number of distinct GTINs in the group of product offer pairs that has the same brand name pair divided by a geometric mean of the total number of distinct GTINs in the product offers of the plurality of product offers that comprise the first brand name and the total number of distinct GTINs in the product offers of the plurality of product offers that comprise the second brand name.

19. The computer program product of claim 11, wherein each product offer further comprises a manufacturer part number ("MPN") for the product subject to the product offer and wherein the at least one brand pair parameter comprises a total number of distinct MPNs in the group of product offer pairs that has the same brand name pair divided by a geometric mean of the total number of distinct MPNs in the product offers of the plurality of product offers that comprise the first brand name and the total number of distinct MPNs in the product offers of the plurality of product offers that comprise the second brand name.

20. The computer program product of claim 11, wherein parameters of the machine learned classifier model are determined using logistic regression.

21. A system for generating an electronic product catalog, comprising:

computer-readable instructions stored in a computer-readable storage device; and one or more processors programmed to access and execute the computer instructions to:

receive information regarding a plurality of product offers from a plurality of information sources, wherein the received information comprises, for each product offer, a brand name identifying a brand for a product subject to the product offer and a product identifier identifying the product;

perform a statistical analysis on the received information to identify product offers related to the same product, wherein perform a statistical analysis on the received information to identify product offers related to the same product comprises:

identify two or more product offers from the plurality of product offers that have similar product identifiers;

responsive to identifying two or more product offers with similar product identifiers, create one or more product offer pairs with the identified two or more product offers, wherein each product offer pair comprises a first product offer and a second product offer, and wherein the first product offer comprises a first brand name and the second product offer comprises a second brand name;

extract the first brand name from the first product offer and the second brand name from the second product offer of each of the one or more product offer pairs;

responsive to extracting, create based on the first brand name and the second brand name of each of the one or more product offer pairs, one or more brand name pairs;

responsive to creating the one or more brand name pairs, identify at least one group of product offer pairs that have the same brand name pair;

compute, for each product offer pair, at least one product parameter based on at least one first attribute of the first product offer and at least one second attribute of the second product offer in the product offer pair;

compute, for each group of product offer pairs that has the same brand name pair, at least one brand parameter based on the product offer pairs associated with the brand pair group;

apply a machine learned classifier model to the at least one product parameter of each product offer pair of the group of product offer pairs that has the same brand name pair and the at least one brand pair parameter of the group of product offer pairs that has the same brand name pair; and determine, for each group of product offer pairs that has the same brand name pair, whether the first brand name is related to the second brand name based on an output of the machine learned classifier model; and generate the electronic product catalog comprising the identified product offers organized into groups based on the product that the identified products are related to.

22. The system of claim 21, wherein each product offer further comprises a global trade item number ("GTIN") for the product subject to the product offer and wherein the at least one product parameter comprises a measure of similarity between the GTIN for the product subject to the first product offer and the GTIN for the product subject to the second product offer.

23. The system of claim 21, wherein each product offer further comprises a price for the product subject to the product offer and wherein the at least one product parameter comprises a measure of similarity between the price for the product subject to the first product offer and the price for the product subject to the second product offer.

24. The system of claim 21, wherein the at least one product parameter comprises a measure of complexity between the product identifier for the product subject to the first product offer and the product identifier for the product subject to the second product offer.

25. The system of claim 21, wherein the at least one brand parameter comprises a measure of similarity between the first brand name and the second brand name of the brand name pair.

26. The system of claim 21, wherein the at least one brand pair parameter comprises a total number of product offer pairs in the group of product offer pairs that has the same brand name pair divided by a geometric mean of a total of the number of product offers of the plurality of product offers that comprise the first brand name and product offers of the plurality of product offers that comprise the second brand name.

27. The system of claim 21, wherein each product offer further comprises a global trade item number ("GTIN") for the product subject to the product offer and wherein the at least one brand pair parameter comprises a total number of distinct GTINs in the group of product offer pairs that has the same brand name pair divided by a geometric mean of the total number of distinct GTINs in the product offers of the plurality of product offers that comprise the first brand name and the total number of distinct GTINs in the product offers of the plurality of product offers that comprise the second brand name.

28. The system of claim 21, wherein each product offer further comprises a manufacturer part number ("MPN") for the product subject to the product offer and wherein the at least one brand pair parameter comprises a total number of distinct MPNs in the group of product offer pairs that has the same brand name pair divided by a geometric mean of the total number of distinct MPNs in the product offers of the plurality of product offers that comprise the first brand name and the total number of distinct MPNs in the product offers of the plurality of product offers that comprise the second brand name.

29. The system of claim 21, wherein parameters of the machine learned classifier model are determined using logistic regression.

* * * * *